United States Patent [19]

Attar

[11] Patent Number: 4,597,769

[45] Date of Patent: Jul. 1, 1986

[54] COAL DEMINERALIZATION AND DEPYRITIZATION PROCESS

[76] Inventor: Amir Attar, 7817 Haymarket La., Raleigh, N.C. 27609

[21] Appl. No.: 710,220

[22] Filed: Mar. 11, 1985

[51] Int. Cl.[4] ..... C10L 9/02

[52] U.S. Cl. ..... 44/1 SR

[58] Field of Search ..... 44/1 SR; 201/17

[56] References Cited

U.S. PATENT DOCUMENTS 4,030,893 6/1977 Keller ..... 44/1 SR 4,364,740 12/1982 Massey et al. ..... 44/1 SR

FOREIGN PATENT DOCUMENTS 2036073 6/1980 United Kingdom ..... 44/1 SR

*Primary Examiner*—Carl F. Dees

*Attorney, Agent, or Firm*—Mills and Coats

[57] ABSTRACT

The present invention entails a coal demineralization and depyritization process which produces coal with extremely low mineral (ash) and pyrite contents. Essentially the present process calls for the chemical treatment of the coal surface first, followed by a physical separation step in which the minerals are separated from the coal. The chemical step comprises of subjecting and treating the coal surface with an alcohol composition such as methanol for a selected period of time and at a selected temperature within a reactor in the presence of an acid catalyst. This chemical step makes the coal surface non-polar mainly by reacting the alcoholic and carboxylic groups. In particular, this chemical step is designed to reduce the surface forces between the organic and inorganic phases and consequently facilitate the mineral separation. After the chemical treatment of the coal, actual separation of the minerals can be achieved by one of many conventional physical separation process.

11 Claims, 2 Drawing Figures

COAL DEMINERALIZATION AND DEPYRITIZATION PROCESS

FIELD OF INVENTION

The present invention relates to coal and coal treatment processes and more particularly to a process for separating and removing minerals and iron pyrite from coal.

BACKGROUND OF INVENTION

It is an objective of the United States to reduce oil imports and where appropriate to increase the use of coal, resource abundantly available in the United States. Increasing the use of coal can be enhanced if methods which produce coal with a relatively low pyrite and/or mineral content be available, because coal low in pyrite or in mineral content can be used as replacement fuel for petroleum-derived fuels. For example, coal-water slurry can replace heavy residual oil in existing boilers with a minimum derating only if the total solid content of the slurry will be comparable to that of residual oil and the volatility of these solids will not exceed that of the solids in heavy oils. Since numerous boilers, many of which are very new, have been designed to burn heavy oil, finding a coal-based replacement-fuel which will allow the use of these boilers for a longer period of time is extremely desirable.

Besides coal-water slurry or turbine applications, there is a tremendous economic incentive to produce low pyrite and low ash (or low minerals) coal for other applications because such coal can reduce the overall cost of power generation in various applications and the quantity of sulfur oxides emitted upon its combustion.

Past developments in coal preparation processes along with advancement in mining technology have made it possible to produce what is referred to as low mineral content coal. Such coal typically has an ash content of 5 to 10 percent by weight at best with BTU recovery on the order of 60 to 80 percent. These results are not satisfactory because a large fraction of the coal is rejected, which hurts economically and increases the environmental problems associated with disposal of the refuse. Moreover, high ash coals cannot be used at all in many applications including coal-water slurry burners, turbines, and novel motors which use solid fuels. It should be noted that the operation of a coal slurry or a turbine burner is extremely sensitive to the coal ash content and composition. For example, lowering the ash content 1 percent may allow the use of the coal in some applications where it was not previously usable.

There is a real need for a coal demineralization process that is feasible, practical and cost-effective that will reduce the mineral content of coal to below 3 percent by weight, and the pyrite content to below 0.3% while providing a BTU recovery level of at least 70 to 75 percent.

Technologies capable of reducing the ash content of coal to below 3 percent exist today. However, they are expensive, capital-intensive and not fully proven. First, there is what is referred to as "solvent refining" of coal, and secondly, there is a base-fusion process in which the coal is treated by a melted alkali or by a very concentrated alkali solution at elevated temperatures and pressures. Typical costs associated with solvent refining of coal are $40 to $130 per ton with initial capital investment of the order of several hundred million dollars and up to three billion U.S. $/10000 t/day preparation plant.

Coal demineralization by alkali fusion is even less attractive economically and is in a more primitive state of development.

Therefore, there is a significant and real need for a novel coal cleaning process which reduces the ash level to below 3 percent by weight; such process should have a high BTU recovery; should require a relatively small capital investment, and has a very low operating cost.

SUMMARY AND OBJECTS OF INVENTION

The present invention presents a coal cleaning or demineralization process which reduces the mineral level of coal to about the level of the inherent minerals, i.e., 0.3 to 3 percent by weight, the pyrite level to below 0.3% while maintaining the BTU recovery level above 70 to 75 percent. Moreover, the present process requires a relatively small initial capital investment and can be operated very economically.

The coal demineralization process of the present invention first entails a chemical treatment step which is followed by a physical separation process which can be a modified version of one of several conventional methods.

The chemical step entails a mild chemical reaction which reduces the intensity and density of the attraction forces between the mineral particles and the organic surface of the coal. It thusly follows that this chemical treatment step renders the mineral more susceptible for separation by the subsequent physical separation step.

The chemical step basically comprises of subjecting and treating the coal surface with an alcohol composition in the presence of an acid catalyst at a predetermined temperature and residence time. This effectively results in the coal surface becoming non-polar and resulting in the reduction of the surface forces between the organic and inorganic phases so as to allow better mineral separation.

It is, therefore, an object of the present invention to provide a coal demineralization process that will reduce the ash or mineral level of the coal to 3 percent or less by weight, the pyrite content to 0.3 percent by weight or less, while maintaining the BTU recovery level above 70 to 75 percent.

Another object of the present invention resides in the provision of a coal demineralization process of the character referred to above that requires a relatively low capital investment and which can be operated economically. A corrolary objective was to design a process which can be easily integrated with existing coal preparation facilities.

A further object of the present invention is to provide a coal demineralization process that entails chemically treating the surface of the coal to make the same non-polar resulting in the reduction of the surface forces between the organic and inorganic phases of the coal which enables mineral particles to be efficiently removed from the coal by a physical separation process.

Still a further object of the present invention resides in the provision of a coal demineralization process of the character referred to above wherein the surface of the coal is treated with an alcohol composition such as methanol in the presence of an acid catalyst at a predetermined temperature and for residence time.

Other objects and advantages of the present invention will become apparent from a study of the following description.

COAL DEMINERALIZATION AND DEPYRITIZATION PROCESS

Figure 1:
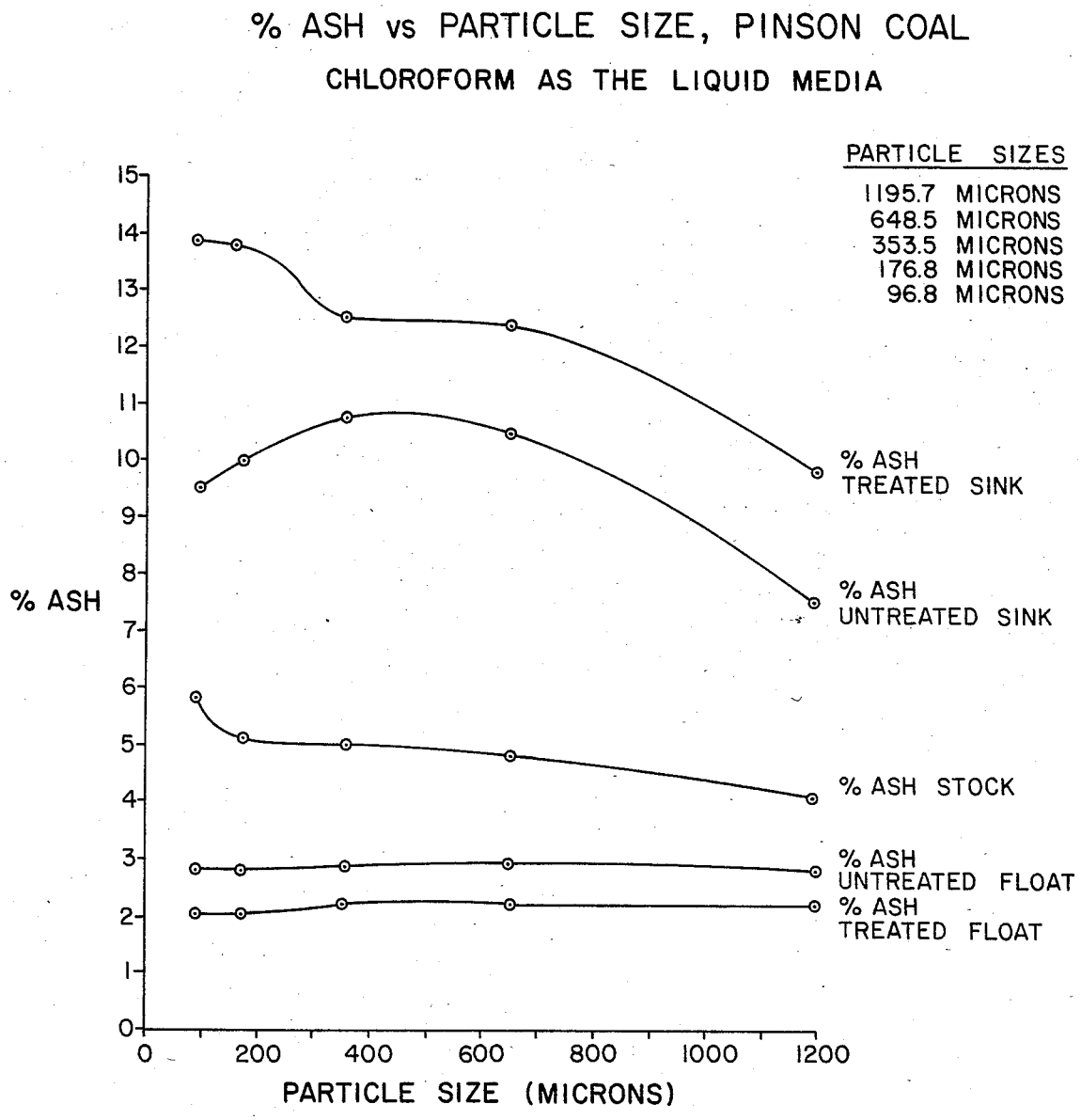
FIG. 1 shows the variation in the percent of ash of the chloroform float and sink fractions versus the particle size for coal samples that were pretreated chemically and for samples that were not treated.

It is first preferable that the coal be crushed and reduced to the proper size. In this regard, the coal can be broken into particles of a $\frac{3}{8}$ inch size or less. It is contemplated that for optimum results that the coal particle size should be smaller than 60 mesh. In subsequent portions of this disclosure, additional attention will be directed to the effect of coal particle size on the efficiency and effectiveness of the present process with respect to the percent of ash remaining after the coal has been subjected to the present process.

Once the coal has been conditioned and prepared to conform to a selected particle size requirements, the coal is transferred into a reactor. In the reactor the chemical treatment of the coal surface is carried on. In this regard the coal demineralization process of the present invention entails treating the coal with a mixture which contains a small alcohol, preferably methanol and an acid catalyst with or without an inert gas. Table 1 describes the range and the preferred values of the treating conditions.

REACTION CONDITION OF THE CHEMICAL STEP (Assuming Use of Methanol)

| Variable | Temperature Degrees C. | Pressure psi | Catalyst | Coal Particle Size | Residence Time, Min. |
|---|---|---|---|---|---|
| Range | 80–250 | 5–300 | Acids | $-\frac{3}{8}''$ | 0–300 |
| Preferred Range | 130–170 | 10–30 | $SO_2$,$CO_2$, $SO_3$ or HCl | −80 mesh | 20–60 |

In this first chemical treatment step, the polar phenolic and alcoholic groups are etherized, and the carboxylic groups esterified. The most important chemical reactions are:

$$ROH + CH_3OH \rightarrow ROCH_3 + H_2O \quad (1)$$

and $$RCOOH + CH_3OH \rightarrow RCOOCH_3 + H_2O \quad (2)$$

The resulting ethers and esters are much less polar than the original alcoholic and carboxylic groups and, therefore, do not attract and hold the mineral particles to the coal surface as strongly.

As a result of the above-discussed chemical treatment, the coal surface becomes much less polar and as such hydrophobic. It should be pointed out that the retention of toluene on the coal surface increases by 16 to 35 percent while the retention of water decreases by over 75 percent. This helps significantly in drying the product.

In the tests that were conducted in this study, the separability of the minerals was determined by float-sink in a medium with gravity of 1.49 gm/cm$^3$. This method was selected only because of its simplicity and not because it simulates any particular physical cleaning process. The ash content of the sink of the chemically pretreated coal was higher than that of the untreated coal. For some coals, the total demineralization decreased once the particle size was reduced below approximately 200 mesh. However, for other coals, no particle size effect was noticeable. For the particle sizes that were tested, $-\frac{3}{8}$ inch and below, and using float-sink in chloroform as a measure of demineralization, the most effective demineralization is obtained for particles in the range of −100+120 mesh. It is expected that more efficient demineralization will be obtained with smaller particles, especially if more efficient physical separation methods are used.

Reference is now made to FIG. 1 which presents data on coal from the Pinson mine. The ash content of the floats and the sinks in chloroform (density 1.49 gm/cm$^3$) was used as a measure of the cleanability. FIG. 1 shows the dependence of the ash content of the float of the feed coal particle size. Although for the Pinson coal no significant dependence on the particle size was observed, the particle size did have a significant effect on the cleanability of some high ash coals.

Figure 2:
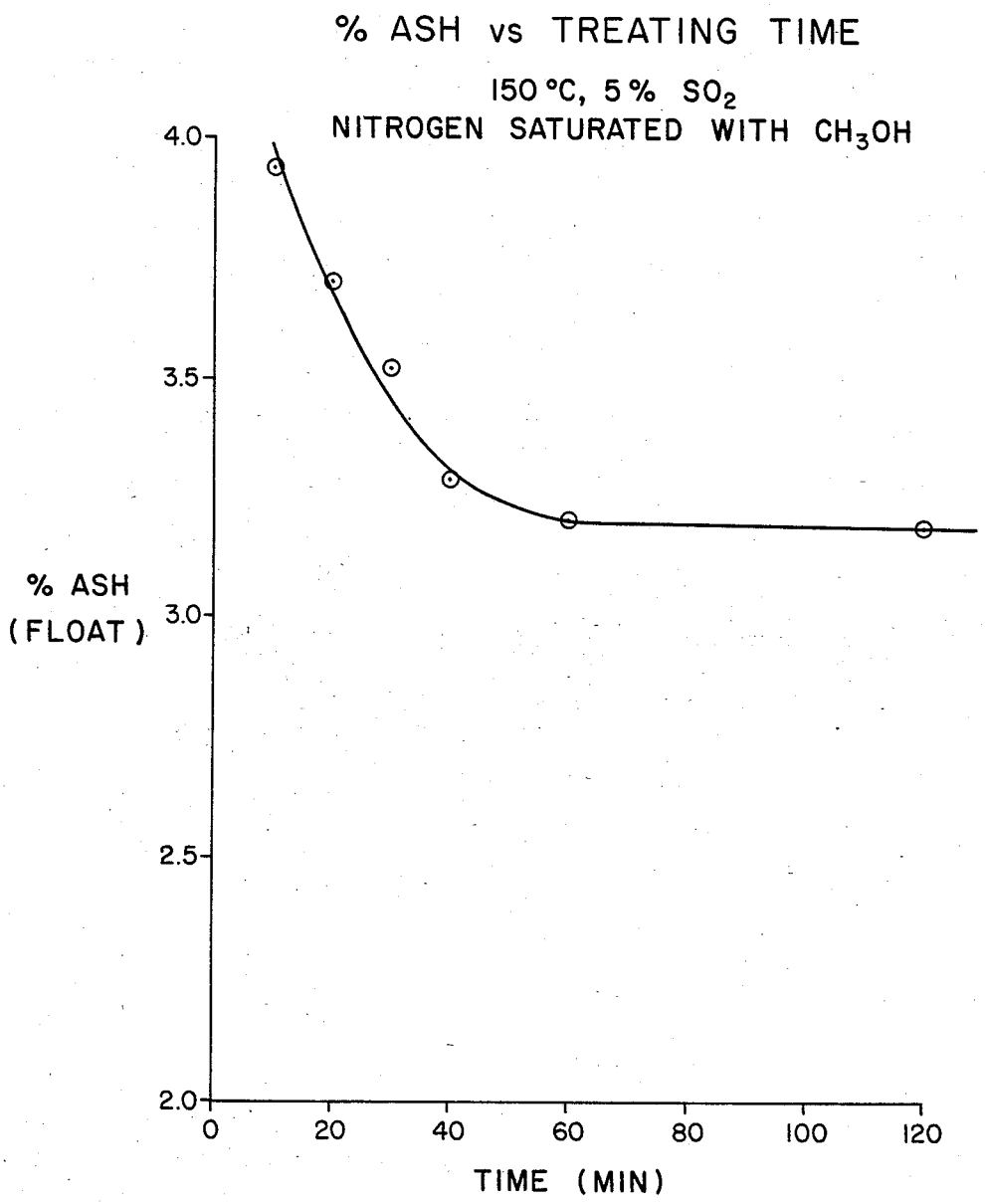
FIG. 2 is a graph illustrating test results that show percent of ash versus the residence time of the coal in the treating reactor.

FIG. 2 shows the effect of the residence to time in the chemical reactor on the cleanability. The data indicate that maintaining the coal more than 40 minutes in the reactor at 150 degrees C. has, in the case of Pinson, adds very little to the cleanability of coal having a −100+120 mesh particle size. This indicates that the majority of the polar surface groups were reacted in 40 minutes or so at 150 degrees C. and that retaining the solid in the reactor for a longer time would have no significant effect on its cleanability.

It is contemplated that the use of a catalyst in the chemical treatment of the coal surface would be beneficial. In test results, it was found that sulfur dioxide, when present, increases the yield of cleaned coal and helped in obtaining a better quality coal. Thus flue gas saturated with methanol can be used to treat the coal.

The following table shows the effect of ash content for runs with and without a catalyst.

ASH CONTENT FOR RUNS WITH AND WITHOUT A CATALYST

| COAL SAMPLE | % ASH FLOAT WITH CATALYST | % ASH FLOAT WITHOUT CATALYST | % ASH IN ORIGINAL COAL |
|---|---|---|---|
| PINSON | 1.90 | 2.63 | 6.0 |
| HELVETIA | 3.21 | 3.79 | 12.7 |

Details of the physical separation step have not been dealt with herein in detail because such are conventional and well known in the coal processing art. Suffice it to point out that once the polar groups of the coal have been neutralized and become non-polar, one of numerous physical separation steps can then be implemented to separate and remove ash or mineral particles from the coal in a conventional fashion.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A coal dimineralization process comprising the steps of: reducing the polar nature of the coal surface and reducing the surface forces between organic and inorganic phases of the coal by chemically treating the surface of the coal in a gas phase by reacting and neutralizing polar alcoholic and carboxylic groups; the step of chemically treating the surface of coal including subjecting the surface of the coal to a gaseous alcohol composition for a selected period of time at a temperature range of 100 degrees to 250 degrees C. and adding to the gaseous alcohol composition and the coal being treated by an acidic gas which acts as a catalyst for the resulting chemical reaction all of which results in a neutralization effect on the polar groups and reduces the forces about the surface of the coal that attract and hold the mineral particles; and after chemically treating the surface of the coal to reduce the forces attracting and holding the mineral particles to the coal, then separating the mineral particles from the coal so as to reduce the mineral content of the coal.

2. The coal demineralization process of claim 1 including subjecting the coal to methanol gas for a period of time of up to 300 minutes at the temperature range of 100 to 250 degrees C.

3. The coal demineralization process of claim 1 including conditioning the coal by breaking the same into particle sizes of $\frac{3}{8}$ inch or less before subjecting the coal to methanol.

4. The coal demineralization process of claim 3 wherein the applied acidic gas catalyst is taken from the group consisting of $SO_2$, $SO_3$, HCl.

5. The coal demineralization process of claim 1 including the step of etherizing the alcoholic groups and esterifying the carboxylic groups to produce ethers and esters that are substantially less polar than the original alcoholic and carboxylic groups and which substantially reduce the forces that attract and hold the mineral particles to said coal.

6. The coal demineralization process of claim 1 wherein the gaseous alcohol composition is taken from the group consisting of methanol gas; ethanol gas; methanol gas and flue gas; methanol gas and an inert gas; ethanol and flue gas; and ethanol and an inert gas.

7. A process for removing minerals from coal comprising the steps of: conditioning the coal by breaking the coal into particle sizes of $\frac{3}{8}$ inch or less; transferring the conditioned coal into a reactor; neutralizing polar alcoholic and carboxylic groups of the coal and converting them to non-polar groups to reduce the surface forces between the organic and inorganic phases of the coal so as to facilitate mineral separation from the coal; said neutralization process including subjecting and treating the surface of the coal in a gas phase with methanol gas in the presence of an acid gas catalyst at a temperature of 110–200 degrees C. for a period of 20 to 80 minutes within said reactor, resulting in the neutralization of the alcoholic and carboxylic groups and in the reduction of the forces attracting and holding mineral particles to the coal; and separating mineral particles from the coal after the neutralization of the alcoholic and carboxylic groups.

8. The process of removing minerals from coal of claim 7 wherein the step of conditioning the coal entails making the coal conform to a −60 mesh coal particle size.

9. The process of removing minerals from coal of claim 7 including the step of adding the catalyst sulfur dioxide in the form of a gas to the coal and methanol gas during the residence time within said reactor.

10. The process of claim 8 wherein the added acid gas catalyst is taken from the group consisting of $SO_2$, $SO_3$, $CO_2$ and HCl.

11. A process for removing minerals from coal comprising the steps of: conditioning the coal by breaking the coal into particle sizes of $\frac{3}{8}$ inch or less; transferring the conditioned coal into a reactor; neutralizing polar alcoholic and carboxylic groups of the coal and converting them to non-polar groups to reduce the surface forces between the organic and inorganic phases of the coal so as to facilitate mineral separation from the coal; said neutralization porcess including subjecting and treating the surface of the coal with an alcohol gas composition taken from the group consisting of methanol gas, ethanol gas, propanol gas and isopropanol gas, in the presence of an acid gas catalyst at a temperature of 100 to 200 degrees C. for a period of 0 to 120 minutes within said reactor, resulting in the reduction of the forces attracting and holding mineral particles to the coal; and separating mineral particles from the coal after the neutralization of the alcoholic and carboxylic groups.

* * * * *